United States Patent [19]

Brovelli

[11] 3,949,950

[45] Apr. 13, 1976

[54] YARN WINDING BOBBIN

[75] Inventor: Loredana Brovelli, Milan, Italy

[73] Assignee: M. Scaglia S.p.A., Italy

[22] Filed: June 20, 1974

[21] Appl. No.: 481,322

[30] Foreign Application Priority Data

July 5, 1973 Italy ..... 26224/73

[52] U.S. Cl. ..... 242/118.6

[51] Int. Cl.[2] ..... B65H 75/14

[58] Field of Search..... 242/118.6, 118.61, 118.7, 242/118.8, 118.4; 74/573

[56] References Cited

UNITED STATES PATENTS

| | | | |
|---|---|---|---|
| 1,627,518 | 5/1927 | Lock | 242/118 |
| 2,059,752 | 11/1936 | Schuster | 242/118.61 |
| 2,499,268 | 2/1950 | Crooks | 242/118.6 |
| 2,610,811 | 9/1952 | Moss | 242/118.61 |
| 2,955,876 | 10/1960 | Kinset | 74/573 X |
| 3,764,083 | 10/1973 | Gretener | 242/118.3 |

*Primary Examiner*—Leonard D. Christian
*Attorney, Agent, or Firm*—McGlew and Tuttle

[57] ABSTRACT

A yarn winding bobbin and a method for manufacturing the same, wherein a core element and two end flanges are removably secured, said flanges and core element being separately and independently statically and dynamically balanced before assembling the bobbin. The core element carries head bodies secured within its open ends, that are adapted to center the flanges and are made in a suitably soft material to allow for the driving thereinto of nail-shaped balancing weights.

8 Claims, 3 Drawing Figures

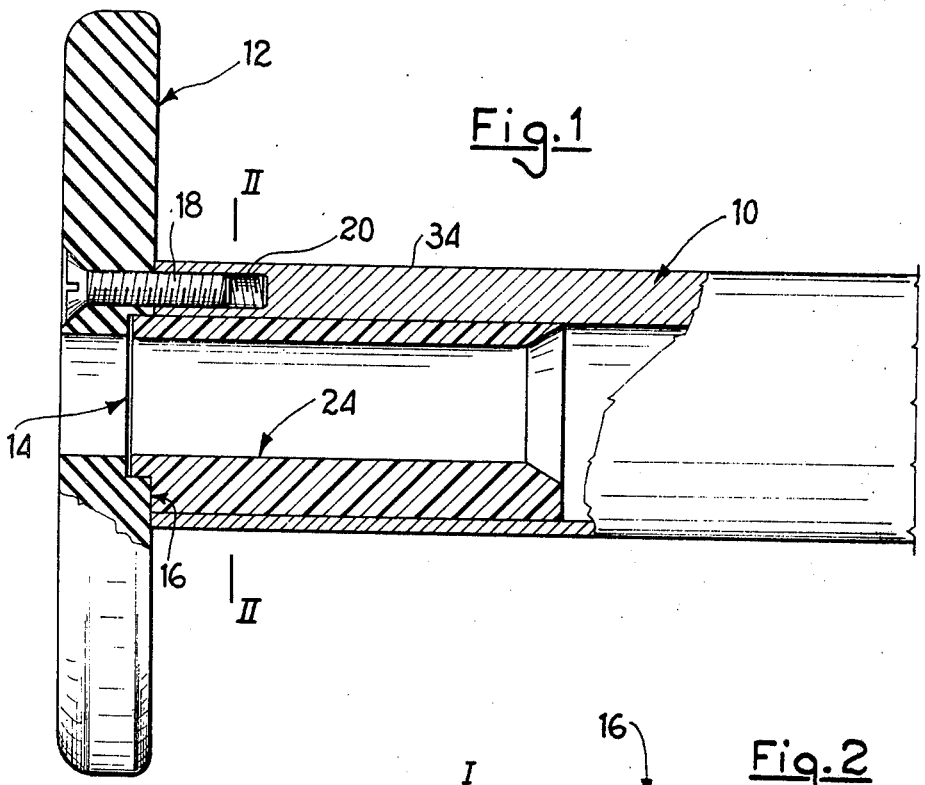
Fig. 1
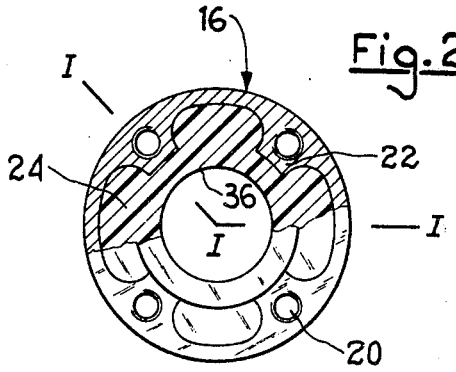
Fig. 2
Fig. 3
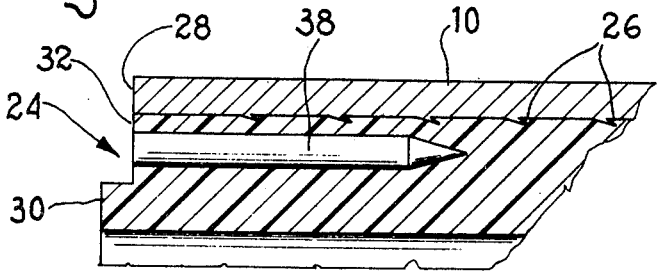

YARN WINDING BOBBIN

BACKGROUND OF THE INVENTION

This invention relates to a novel and improved yarn winding bobbin, as well as to a method for manufacturing the same in order to attain new and advantageous results in the practical use and respectively in manufacturing such bobbins.

More detailedly, this invention relates to a bobbin particularly suitable for winding coarse or thick yarns, i.e. high-count yarns, and essentially comprising a cylindric core and two flanges removably secured to both core ends. As it is well known, the bobbin flanges are removably secured to the bobbin core particularly when using bobbins wherein high count yarns are to be wound and wherein no danger exists that the yarn become clamped between the bobbin core ends and the flanges, due to removing and approaching movements of core and flange opposite normally contacting surfaces, as caused by the outside axially directed stresses exerted onto the flanges by the wound yarn in a full bobbin, and respectively by the flange resiliency in an empty bobbin. Obviously, when handling high count yarns, a given relative motion of said opposite core and flange surfaces is yet admissible, provided that no openings wider than the yarn diameter will formed under the greatest possible stresses.

Said removable flanges are usually fastened by means of screws to the core ends and are advantageous in that they may be easily and quickly replaced in cases of flange breakages. However, such flange replacement may involve drawbacks in particular for bobbins designed to operate on modern equipments running at high and very high speeds.

Indeed, a bobbin static and dynamic balancing operation is usually required, in particular when dealing with bobbins operating at high speeds. Such balancing operation is usually carried-out by inserting or securing one or more balancing weights to one or more bobbin flanges, at circumferentially selected and axially eccentric positions thereof. Obviously, when a broken flange is to be replaced, the previously performed balancing operation is no more effective and a new balancing operation ought to be made by the bobbin user, that however does not usually possess the necessary equipments.

SUMMARY OF THE INVENTION

Accordingly, an object of this invention is to provide a novel and improved bobbin of the removable flange type, as well as a method for producing such bobbin, that allow to avoid the necessity to newly balance said bobbin upon replacement of one or both flanges thereof, said novel bobbin further showing a very simple and unexpensive design.

According to this invention, a composite bobbin of the previously defined type is provided, wherein the single bobbin components are statically and dynamically separately balanced, so that the balancing of the whole bobbin cannot be affected by the replacement of anyone of its components. In practice, it has been ascertained that a satisfactory balancing degree is inherently shown by the bobbin flanges, along with the means for removably securing the same to the bobbin core, and accordingly no necessity exists of balancing said flanges.

Conversely, a balancing operation is required for the bobbin core and such operation may be performed by arranging suitable balancing weights in eccentric and circumferentially selected positions on the core body. More detailedly, according to this invention, the bobbin core comprises heads in a suitable material, e.g. a plastics material, wherein said balancing weights, in the form of needles or the like, may be driven until reaching a position wherein a subsequent flange securing operation to the same heads is not hindered.

As previously stated, this invention also relates to a method for producing a bobbin of the disclosed type and wherein a static and possibly dynamic balancing step is provided at least for the bobbin core alone, before the bobbin flanges being fitted thereto.

BRIEF DESCRIPTION OF THE DRAWINGS

FIG. 1 is a side view with parts in section of a bobbin according to this invention, said section being taken along the line I—I of FIG. 2.

FIG. 2 is a section view taken along the line II—II of FIG. 1.

FIG. 3 is an enlarged partially sectioned view of a bobbin core head wherein a balancing weight is driven.

DESCRIPTION OF THE PREFERRED EMBODIMENT

Referring now to the drawings and firstly to FIGS. 1 and 2, a bobbin particularly suitable for winding high count yarns substantially comprises a core 10 and two end flanges 12 (only one flange being shown in FIG. 1), that are removably fitted to core ends. More detailedly, said core consists of a tubular length in a suitable material, as glass fiber reinforced resin or metallic material, while said flanges 12 are substantially disk-shaped and show a centering slot 14, as well as an abutting surface 16 for the core ends and suitable means for fastening the same to said core 10. In the considered example, said fastening means are in the form of holes for suitable screws 18, that engage with threaded blind holes 20, as provided in the core ends. Said flanges may be in any suitable material, e.g. plastics material and they may be substantially balanced in respect to their axis, due to the design thereof.

Said core 10 preferably shows a number of inner ribs 22, f.i. four ribs, wherein said threaded blind holes 20 are formed at both core ends, while the core end surface 28 wherefrom said holes 20 are formed acts as an abutting shoulder for said flange abutting surface 16.

Into each core end a separed head body 24 is suitably inserted and firmly retained, e.g. by engagement with locking peaks 26, previously formed in the core inner surface material by means of a suitable tool, said bodies 24 showing a shape corresponding to the core inner section, as well as a cylindric projection 30, axially extending from the related core end and designed to engage with a recess 14 of a related flange in order to center the same. The annular outer surface 32 of the remaining body portion is coplanar with the surface 28 of the related core end.

Many advantages, from both structural and operational viewpoints may be obtained from the previously described core structure, having core heads comprising said bodies 24. First of all, the core 10 may be obtained from a length of drawn tube and a simple and unexpensive good balancing thereof may be reached already in the core production. Moreover, and in particular when using a metallic core, the core outer side surface 34, whereon the yarn is to be wound, can be accurately finished by a suitable machine tool wherein said core can be centered through said bodies 24 in order to obtain a surface 34 exactly coaxial with the bobbin rotation axis, as defined by axial openings 36 in said bodies 24.

But above all, said bodies 24 are preferably made in a suitably soft material, e.g. a not reinforced plastics material, allowing to perform a separate and independent core balancing operation, before fitting the flanges thereon, in order to obtain an accurately balanced assembly, having single components that are independently previously balanced. Thus, a replacement of anyone of said components, and in particular a flange replacement, does not involve the necessity of newly balancing the whole assembly. Said core balancing operation may be performed by driving balancing weights into suitably selected points of said bodies 24, said balancing weights being in the form of headless nails or the like, e.g. as shown by 38 in FIG. 3, that are driven from the body side surface 32 into the body material, until their rear ends are flush with the same surface 32, to prevent any flange fitting hindrance. Said balancing weights are preferably applied to portions of surface 32 having greater sizes in radial direction, i.e. to portions lying between the ribs 22.

It is to be understood that, while this invention has been described with reference to a preferred embodiment thereof, various changes and modifications may be made therein, particularly with reference to the core structure and the flange securing means, as well as to the form and mode of application of balancing weights and bodies 24 in-to the core ends to form suitable core heads.

I claim:

1. A yarn winding bobbin, particularly for high count yarn, comprising a hollow core, a flange secured to each end of said core, a head body secured in said core between said flanges, and at least one balancing weight extending axially through a portion of said body.

2. A yarn winding bobbin, according to claim 1, wherein said head body comprises a soft material, said balancing weight comprising a nail driven into said soft material.

3. A yarn winding bobbin, according to claim 1, wherein said hollow core includes radially inwardly extending rib portions extending along the axis thereof at circumferentially spaced locations, said head body including radially outwardly extending portions disposed between said ribs and locking said head body between said ribs, said balancing weight extending through a portion of said head body which extends radially outwardly and between said ribs.

4. A yarn winding bobbin, according to claim 3, wherein at least one of said flanges includes an end abutting surface abutting said head body and a threaded screw extending through said flange and threaded into said core at the location of at least one of said inwardly extending ribs of said core.

5. A bobbin according to claim 1, wherein said core consists of a length of a drawn tube, having inner ribs carrying threaded seats for flange securing screws, and wherein said head body is in the form of plastic element having an axial length less than the core axial length.

6. A bobbin according to claim 5, wherein a head body is forced within each of said core element ends and engage with previously roughened portions of said core element inner surface.

7. A bobbin according to claim 6, wherein the core is in a metallic material and the outer surface thereof is finished on a machine tool.

8. A yarn winding bobbin, according to claim 1, wherein said head body is made of a plastic material and has an outer circumference with locking peaks interengaged with the interior wall of said hollow core.

* * * * *